US010851754B2

(12) United States Patent
Lahrman

(10) Patent No.: US 10,851,754 B2
(45) Date of Patent: Dec. 1, 2020

(54) STARTER SOLENOID WITH DUAL COILS AND AXIAL DIODES

(71) Applicant: BorgWarner Inc., Auburn Hills, MI (US)

(72) Inventor: Joshua B. Lahrman, New Palestine, IN (US)

(73) Assignee: BorgWarner Inc., Auburn Hills, MI (US)

( * ) Notice: Subject to any disclaimer, the term of this patent is extended or adjusted under 35 U.S.C. 154(b) by 606 days.

(21) Appl. No.: 15/646,809

(22) Filed: Jul. 11, 2017

(65) Prior Publication Data

US 2019/0017483 A1 Jan. 17, 2019

(51) Int. Cl.

| | |
|---|---|
| ***H01H 9/30*** | (2006.01) |
| ***F02N 11/08*** | (2006.01) |
| ***H01F 7/16*** | (2006.01) |
| ***H01F 7/18*** | (2006.01) |
| ***H01F 5/04*** | (2006.01) |

(52) U.S. Cl.

CPC ..... *F02N 11/08* (2013.01); *H01F 5/04* (2013.01); *H01F 7/1607* (2013.01); *H01F 7/1811* (2013.01); *F02N 2011/0892* (2013.01)

(58) Field of Classification Search

CPC ..... H01F 5/04

USPC ..... 335/201

See application file for complete search history.

(56) References Cited

U.S. PATENT DOCUMENTS

| | | | | |
|---|---|---|---|---|
| 3,215,902 | A | 11/1965 | Foley et al. | |
| 4,028,654 | A * | 6/1977 | Bullard | H01F 5/04 336/92 |
| 4,117,821 | A | 10/1978 | Kawai | |
| 5,423,117 | A * | 6/1995 | Okada | H01F 7/06 264/272.19 |
| 6,033,189 | A * | 3/2000 | Miura | F16K 31/0655 417/222.2 |
| 6,057,749 | A * | 5/2000 | Doneghue | H01H 50/021 335/128 |
| 7,224,253 | B2 * | 5/2007 | Chung | F16D 27/112 192/84.1 |
| 7,710,231 | B2 * | 5/2010 | Akimoto | H01F 38/12 336/90 |

(Continued)

FOREIGN PATENT DOCUMENTS

| | | | |
|---|---|---|---|
| JP | 2008196373 | A | 8/2008 |
| JP | 2013256870 | A | 12/2013 |
| JP | 2015207344 | A | 11/2015 |

*Primary Examiner* — Alexander Talpalatski

(74) *Attorney, Agent, or Firm* — Maginot, Moore & Beck LLP

(57) ABSTRACT

A solenoid for a motor vehicle starter includes at least one coil wound on at least one spool, the at least one coil defines a toroidal space encircling the at least one coil. A stop member is positioned adjacent to the at least one spool. A diode holder is positioned in the toroidal space defined by the at least one coil, and a diode is positioned in the diode holder. The diode includes a cylindrical body, a first lead extending from a first end of the cylindrical body, and a second lead extending from a second end of the cylindrical body. The cylindrical body of the diode is retained by the diode holder within the toroidal space, and the first lead of the diode extends out of the toroidal space and is electrically connected to the stop member.

17 Claims, 5 Drawing Sheets

(56) References Cited

U.S. PATENT DOCUMENTS

| | | | | |
|---|---|---|---|---|
| 8,570,123 | B2 * | 10/2013 | Niimi | H01H 51/065 335/126 |
| 8,587,397 | B2 * | 11/2013 | Hasel | H01F 5/04 335/250 |
| 2009/0026896 | A1 | 1/2009 | Andoh | |
| 2009/0260608 | A1 * | 10/2009 | Fujiyama | H01F 3/00 123/634 |
| 2011/0279203 | A1 * | 11/2011 | Chung | H01H 50/023 335/205 |
| 2015/0369194 | A1 * | 12/2015 | Ozdemir | H01F 7/08 123/179.28 |
| 2015/0369196 | A1 * | 12/2015 | Gentry | F02N 11/087 123/179.24 |

* cited by examiner

STARTER SOLENOID WITH DUAL COILS AND AXIAL DIODES

FIELD

This document relates to the field of vehicle starters, and more particularly, to solenoids for starter motor assemblies.

BACKGROUND

Starter motor assemblies that assist in starting engines, such as engines in vehicles, are well known. A conventional starter motor assembly includes a solenoid, an electric motor, and a gear mechanism. The solenoid includes a coil that is energized by a battery upon the closing of an ignition switch. When the solenoid coil is energized, a plunger moves in a linear direction, causing a shift lever to pivot, and forcing a pinion gear into engagement with a ring gear of a vehicle engine. When the plunger reaches a plunger stop, electrical contacts are closed connecting the electric motor to the battery. The energized electric motor then rotates and provides an output torque to the drive mechanism. The drive mechanism transmits the torque of the electric motor through various drive components to the pinion gear which is engaged with the ring gear of the vehicle engine. Accordingly, rotation of the electric motor and pinion results in cranking of the engine until the engine starts.

The solenoid of the starter motor assembly typically includes at least one suppressor diode. The suppressor diode is a diode that is connected in parallel with the coil and configured to eliminate or reduce sudden voltage spikes that may be experienced across the coil's inductive load when the current to the coil is suddenly reduced or interrupted. In at least some solenoid arrangements, these suppressor diodes are physically retained adjacent to the spools that retain the solenoid coils. For example the suppressor diodes may be retained within pockets of a spacer positioned between two solenoid coils, such as the diodes discussed in association with United States Publication No. 2015/0369196, to Remy Technologies, LLC, the entire contents of which are incorporated herein by reference. With this arrangement, diodes with standard lead lengths cannot be used because the diode leads must be routed through significant lengths to connect to the solenoid circuit. Instead, diodes with leads of non-conventional lengths must be used in these designs. Unfortunately, these diodes drive up lead times and production costs for the solenoid. Accordingly, it would be advantageous to provide a solenoid arrangement that may be used with diodes having standard lead lengths. Such an arrangement would be advantageous in reducing lead times and costs for the production of the solenoid and the associated starter motor.

SUMMARY

In accordance with one exemplary embodiment of the disclosure, there is provided a solenoid for a motor vehicle starter. The solenoid includes at least one coil wound on at least one spool, and the at least one coil defines a toroidal space encircling the at least one coil. A stop member is positioned adjacent to the at least one spool. A diode holder is positioned in the toroidal space defined by the at least one coil and a diode is positioned in the diode holder. The diode includes a cylindrical body, a first lead extending from a first end of the cylindrical body, and a second lead extending from a second end of the cylindrical body. The cylindrical body of the diode is retained by the diode holder within the toroidal space, and the first lead of the diode extends out of the toroidal space and is electrically connected to the stop member.

In at least one embodiment a solenoid for a motor vehicle starter includes a solenoid housing with at least one spool arranged in the housing. The at least one spool includes a first end flange and a second end flange. At least one coil is retained on the at least one spool and defines a winding axis. At least one diode holder is arranged in the housing between the first end flange and the second end flange of the spool. The at least one diode holder includes a body providing at least one diode cavity. At least one diode is retained in the at least one diode cavity and is electrically connected to the at least one coil.

In at least one embodiment, a solenoid for a motor vehicle starter includes an electric motor retained within a motor housing with a solenoid housing adjacent to the motor housing. At least one spool is arranged in the solenoid housing, the at least one spool including a first end flange and a second end flange. At least one coil is retained on the at least one spool. At least one diode holder is arranged in the housing between the first end flange and the second end flange of the spool. At least one diode is retained in the at least one diode holder, the at least one diode being electrically connected to the at least one coil.

The above described features and advantages, as well as others, will become more readily apparent to those of ordinary skill in the art by reference to the following detailed description and accompanying drawings. While it would be desirable to provide a solenoid that provides one or more of these or other advantageous features, the teachings disclosed herein extend to those embodiments which fall within the scope of the appended claims, regardless of whether they accomplish one or more of the above-mentioned advantages.

DESCRIPTION

Figure 1:
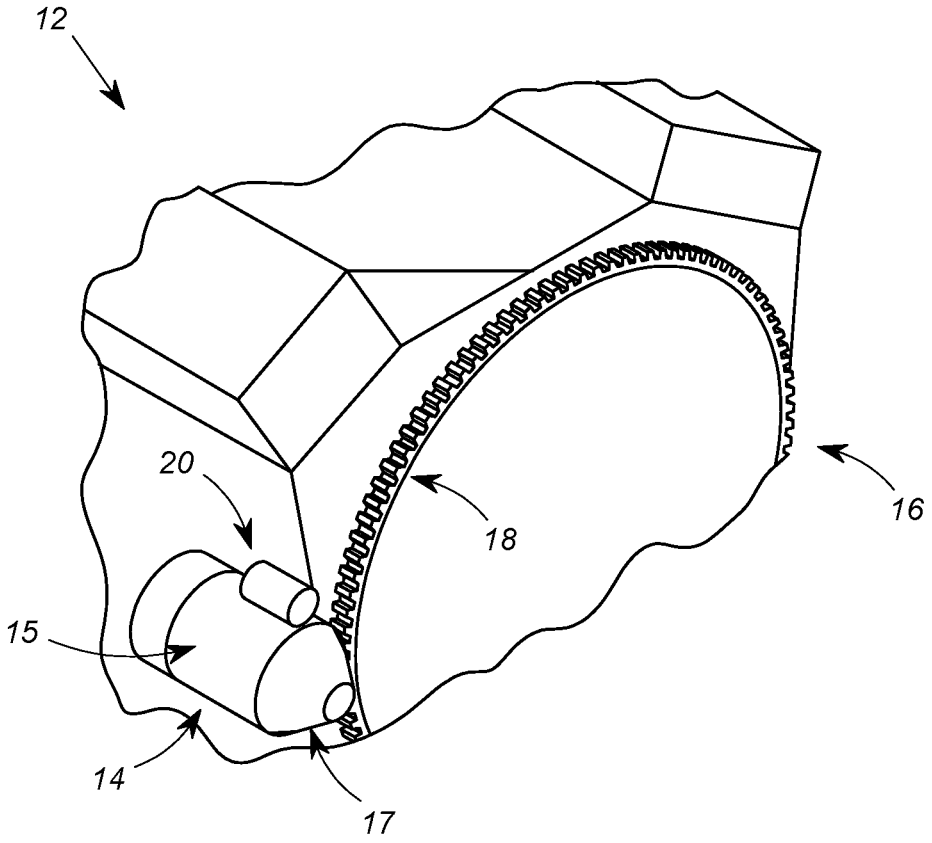
FIG. 1 shows a perspective view of a starter with a solenoid positioned in a motor vehicle engine.

An exemplary embodiment of an internal combustion engine is shown in FIG. 1. The internal combustion engine 12 includes a starter 14 and a ring gear 16 having a plurality of ring gear teeth 18. Specifically, the starter 14 includes an electric motor that engages and rotates ring gear 16 to initiate operation of the internal combustion engine 12. The starter 14 includes a motor housing 15 and a nose or pinion housing 17. A solenoid 20 is operably coupled to starter motor 14. The starter motor 14 includes an output shaft (not shown) that supports an overrun clutch and a pinion gear (also not shown) that selectively engages with ring gear 16.

Figure 2:
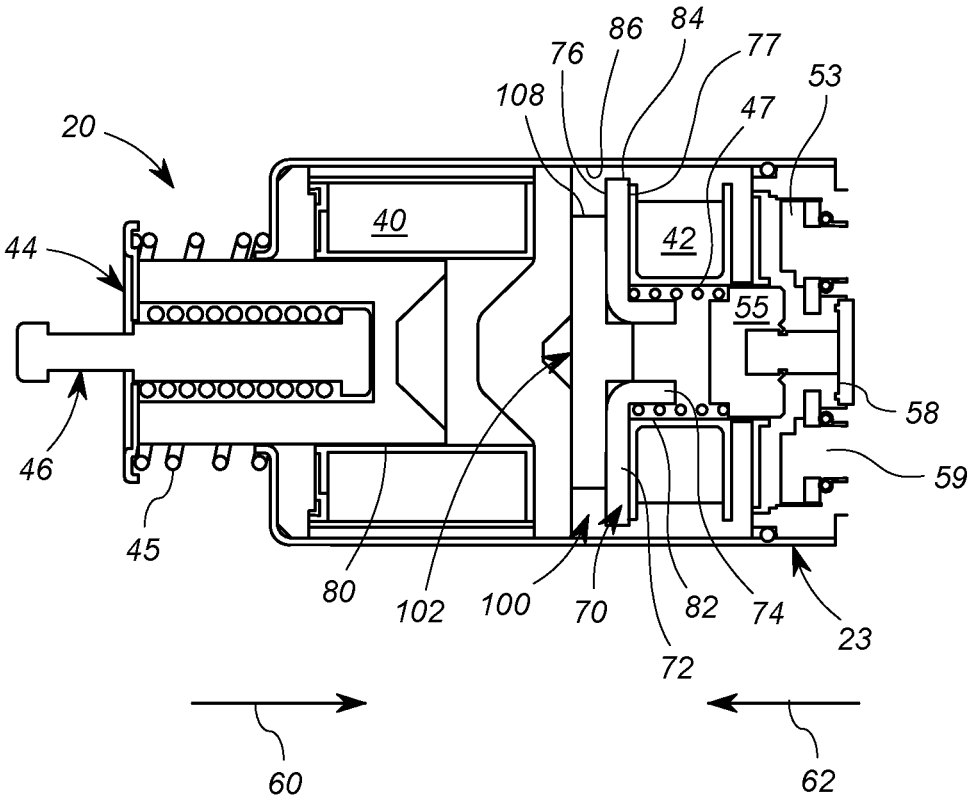
FIG. 2 shows cross-sectional view of the solenoid of FIG. 1.
Figure 3:
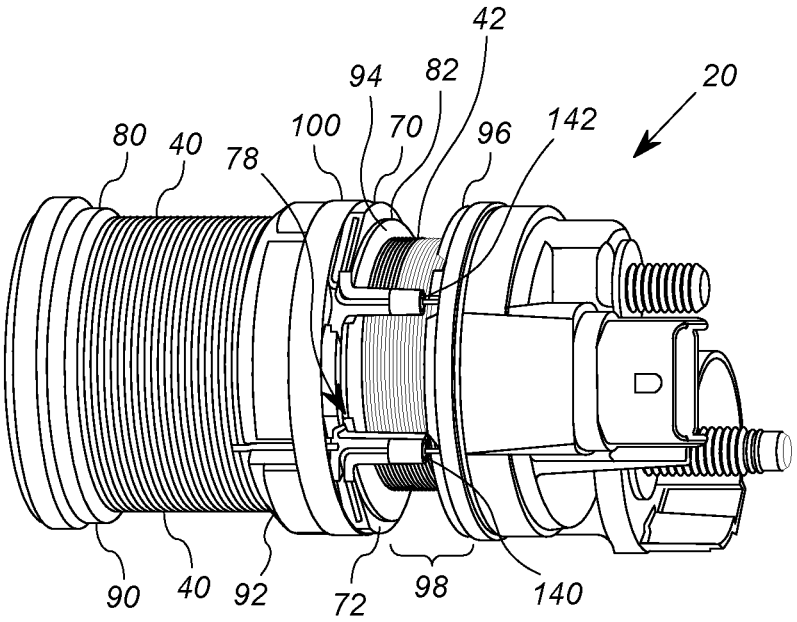
FIG. 3 shows a perspective view of the solenoid of FIG. 1 with the solenoid housing removed to expose the coils of the solenoid.

As shown in FIGS. 2 and 3, the solenoid 20 includes a housing 23 that surrounds a first coil 40, a second coil 42, and a plunger assembly 44. The first coil 40 is retained on a first spool 80, and the second coil 42 is retained on a second spool 82. The first spool 80 includes a generally cylindrical hub (not shown) which the first coil 40 is wound around, a first end flange 90 positioned at one end of the hub, and a second end flange 92 positioned at the opposite end of the hub. The second spool 82 is similar to the first spool 80, and also includes a hub (not shown) a first end flange 94, and a second end flange 96. A toroidal space 98 encircles the second coil 42 and is defined in an axial direction between the first end flange 94 and the second end flange 96. The toroidal space is defined in a radial direction outwardly past the perimeter of the flanges 94 and 96 and to the solenoid housing. The toroidal space 98 includes a first portion extends radially outward from the second coil 42 to a cylinder formed between the perimeters of the first end flange 94 and the second end flange 96, and a second portion that extends past the first portion to the solenoid housing 23.

The plunger assembly 44 of the solenoid is operably coupled to a lever (not shown) at a notch 46 on a rod of the plunger assembly. The plunger assembly 44 also includes a return spring 45. Electrical energy passing through switch terminals (not shown) energizes one or more of first and second coils 40 and 42. The first coil 40 (which may also be referred to herein as a "drive winding") creates a magnetic flux that draws in actuator assembly 44 (in the direction of arrow 60 in FIG. 2), thereby causing the lever to shift the pinion gear along the output shaft and into engagement with ring gear 16. Similarly, the second coil 42 (which may also be referred to herein as a "mag switch winding") creates a magnetic flux that draws in an actuator 55 (in the direction of arrow 62 in FIG. 2). As a result, the contact 58 coupled to the actuator 55 is moved into engagement with the first terminal 53 and the second terminal 59 of the starter, and a flow of electrical energy is established from the first terminal 53, through the contact 58, and to the second terminal 59, thereby causing starter motor 14 to be energized and the pinion gear to rotate.

With continued reference to FIGS. 2 and 3, the solenoid 20 further includes a spacer 100 and a conductive stop member 70. The spacer 100 is positioned axially between the first coil 40 and the second coil 42 and physically separates the first coil 40 from the second coil 42. In the disclosed embodiment, the spacer 100 is generally provided as a plate-like member with a circular perimeter surface 108. The spacer is formed from a non-electrically conductive material such as nylon, Acrylonitrile-Butadiene-Styrene (ABS) plastic, or the like. As explained in further detail below, the spacer 100 is integrally formed with two diode holders 110, 112.

The stop member 70 is positioned adjacent to the spacer 100. The stop member 70 is formed from an electrically conductive material, such as steel or other metal. The stop member 70 is generally formed as a plate-like structure and includes a disc portion 72 and a center cylindrical portion 74. The disc portion 72 is positioned between the spacer 100 and the second coil 42. A first axial surface 76 on a first side of the disc portion 72 abuts the spacer 100, and a second axial surface 77 on a second side of the disc portion abuts the second spool 82 that supports the second coil 42. At least one opening 78 is provided in the disc portion, thus provided a passage from the first side to the second side of stop member 70. As explained in further detail below, the spacer 100 extends through the at least one opening 78. The disc portion 72 also includes a perimeter wall 84 defined along an outer circumferential edge of the disc portion. At least a portion of the perimeter wall 84 contacts an inner surface 86 of housing 23, thereby establishing an electrical ground. The cylindrical portion 74 of the stop member 70 extends into an interior space defined by the second coil 42 and the associated spool 82. Accordingly, the cylindrical portion 74 of the stop member 70 defines a travel limiter for the actuator 55 within the second coil 42. A return spring is positioned between the disc portion 72 of the stop member 70 and the actuator 55, and biases the actuator 55 away from the stop member 70.

Figure 4:
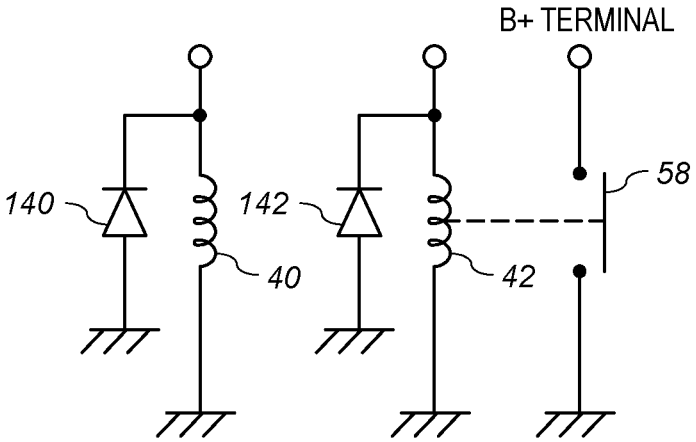
FIG. 4 shows a schematic of the coils of FIG. 3 in a starter motor circuit.

Each coil 40, 42 of the solenoid 20 is associated with a suppressor diode. In particular, diode 140 is associated with the first coil 40, and diode 142 is associated with the second coil 42. FIG. 4 shows a schematic representation of the first coil 40 and the second coil 42 in isolation in a starter motor circuit along with an ignition switch 66. As shown in FIG. 4, the first diode 140 is electrically connected in parallel with the first coil 40. The second diode 142 is electrically connected in parallel with the second coil 42. The first diode 140 and the second diode 142 act as suppressor diodes that reduce or eliminate sudden voltage spikes seen across the inductive load of the associated coil when the current to the coil is suddenly reduced or interrupted. Further details concerning an exemplary arrangements for various coils within a starter motor circuit is described in further detail in U.S. Pat. No. 9,424,972, the entire contents of which are incorporated herein by reference.

Figure 5:
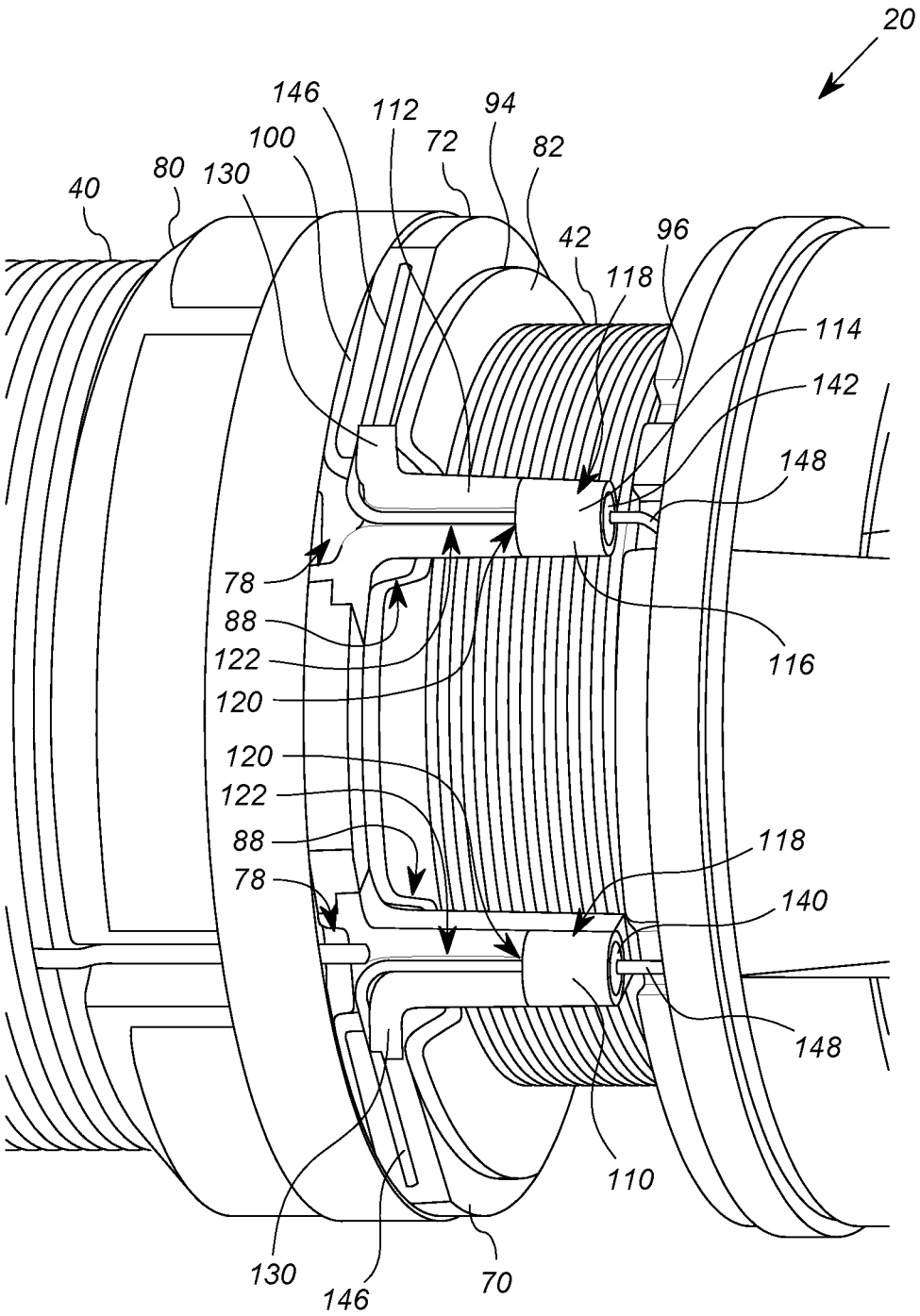
FIG. 5 shows an enlarged view of one of the coils of FIG. 3 with diodes positioned in the toroidal space surrounding the coil.
Figure 6:
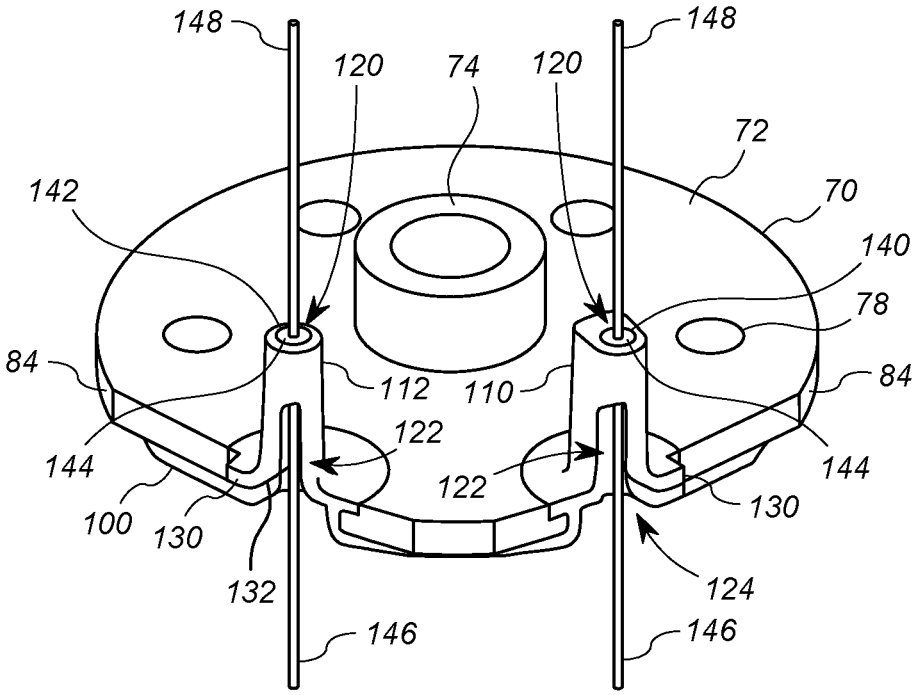
FIG. 6 shows a perspective view of a stop member and a diode holder of the solenoid of FIG. 3 prior to the diode leads being connected to the stop member.
Figure 7:
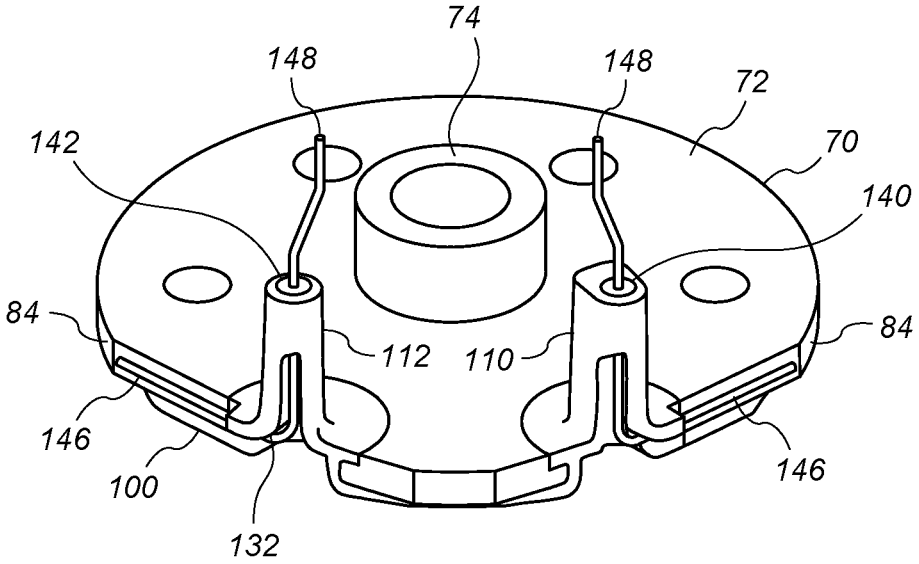
FIG. 7 shows the stop member and diode holder of FIG. 6 with the diode leads bent into position for connection to the stop member.

With particular reference now to FIGS. 5-7, in accordance with an exemplary embodiment, the solenoid 20 includes a first diode holder 110 and a second diode holder 112 arranged in the toroidal space 98 defined by the second coil 42. Each diode holder 110, 112 includes a body 114 formed from a non-electrically conductive material such as nylon, Acrylonitrile-Butadiene-Styrene (ABS) plastic or the like. The body 114 is provided in the form of a cylindrical tower 116 having a substantially cylindrical outer surface 118. The cylindrical shape of the tower 116 defines an axis that is substantially parallel to the axis defined by the second coil 42. The tower 116 includes a diode cavity formed in a distal portion of the tower 116 and a lead passage 122 formed in a proximal portion of the tower 116. The lead passage 122 includes an opening configured to expose a diode lead extending through the lead passage 122. The lead passage 122 directs and protects a diode lead passing from the diode cavity 120 toward stop member 70. The diode cavity 120 is designed and dimensioned to retain and protect the cylindrical body of a diode. In at least one embodiment, the diode cavity 120 is slightly tapered moving from the proximal end toward the distal end of the tower 116. The distal end of the tower 116 is open but is dimensioned to prevent the cylindrical body of a diode from passing therethrough. Accordingly, the diode may be wedged into the diode cavity until it is securely retained therein with a friction fit. While the diode cavity 220 has been described herein as providing a friction-fit arrangement for the diode, it will be recognized that in other embodiments, the diode cavity 220 may be configured to retain the diode in a different manner. For example, in at least one embodiment, a diode retention feature receives the diode in a snap fit arrangement is provided in the diode cavity. Such embodiment may include retaining members configured to elastically deform to receive the diode. Once received, the retaining members exert a biasing force on the diode.

In addition to the tower 116, each diode holder 110 also includes a bending tab 130 positioned at a base of the tower 116. In particular, the bending tab 130 is positioned at the end of the opening in the lead passage 122 of the tower. The bending tab 130 is a generally box-shaped structure that projects radially outward past the tower 116 and past the perimeter wall 84 of the stop member 70. As explained in further detail below, the bending tab is designed to provide a fulcrum that assists a user in bending the distal end of a diode lead extending out of the tower 116 about 90° relative to the proximal end of the lead that is positioned in the tower. The bending tab 130 may include a curved inner surface 132 to facilitate bending of a diode lead without cutting into the lead with a sharp edge.

The diode holders 110, 112 are integrally formed with the spacer 100 such that the diode holders 110, 112 and the spacer 100 are provided as a unitary or monolithic component. However, because the spacer 100 and diode holder 110, 112 are provided on opposite sides of the stop member 70, some connection is formed between portions of the monolithic component on opposite sides of the stop member 70. As best shown in FIG. 6, the stop member 70 includes a plurality of openings 78 and the spacer 100 extends into these openings 78. The diode holders 110, 112 are connected to the spacer 100 at two of these openings. Accordingly, the spacer 100 abuts the first side of the stop member 70 and extends into the openings. Each diode holder 110, 112 extends away from an opening 78 on the opposing second side of the stop member 70. As shown in FIG. 6, the openings 78 may be complete openings formed in a central portion of the stop member, or may be openings provided by recesses formed at a perimeter of the stop member 70. For openings formed by recesses at the perimeter of the stop member, the material that forms the spacer 100 and/or diode holders 110, 112 is exposed along the perimeter of the stop member 70.

In addition to the stop member 70, the second spool 82 that retains the second coil 42 also includes a plurality of openings 88, as shown in FIG. 5. In the disclosed embodiment, these openings are provided by recesses in the perimeter of the end flange 94 of the second spool 82. These recesses allow the diode holders 110, 112 to pass through the end flange 94, from a first side to a second side of the end flange, and into the toroidal space 98 where the diodes are retained.

With particular reference to FIGS. 5 and 6, the first diode 140 is positioned in the diode cavity 120 of the first diode holder 110, and the second diode 142 is positioned in the diode cavity 120 of the second diode holder 112. Each diode 140, 142 includes a cylindrical body 144, a first lead 146 extending from a first end of the cylindrical body 144, and a second lead 148 extending from a second end of the cylindrical body 144. The cylindrical body 144 is held within the diode cavity 120 such that an axis defined by the cylindrical body 144 is substantially parallel to the axis defined by the second coil 42. The second lead 148 extends from a second end of the cylindrical body 144 and is connected to electronic circuitry within the end cap of the solenoid, near the terminals. The first lead 146 extends from a first end of the cylindrical body 144, through the lead passage 122 and out of an end of the tower 116.

With particular reference now to FIGS. 6 and 7, the diode holders 110, 112 provide a convenient method for securing diodes within the solenoid and connecting the leads of the diodes to the stop member 70. First, the diodes 140, 142 are inserted into the towers 116 of the diode holders 110, 112 with each cylindrical body 144 within the diode cavity 120 and the leads 146, 148 extending outward from the towers 116 in opposite directions. Next, with the first lead 146 extending out of the proximal end of the tower 116 as shown in FIG. 6, a technician may place his thumb or finger on the end of the lead 146 and force the lead 146 against the curved inner surface 132 of the bending tab 130. This force causes the lead to deform until it is bent about 90° as shown in FIG. 7. At this time the lead 146 is oriented in a correct position against the perimeter wall 84 of the stop member 70. The technician may then weld or otherwise electrically connect the lead to the stop member 70 in order to form an electrical connection between the diode 140 or 142 and the stop member 70. Advantageously, the solenoid with diode holders as described herein allows diodes with shorter leads to be used within the solenoid. In particular, standard diodes may be used within the solenoid which reduces both costs and lead times to manufacture the solenoid.

The foregoing detailed description of one or more embodiments of the solenoid with dual coils and axial diodes has been presented herein by way of example only and not limitation. It will be recognized that there are advantages to certain individual features and functions described herein that may be obtained without incorporating other features and functions described herein. Moreover, it will be recognized that various alternatives, modifications, variations, or improvements of the above-disclosed embodiments and other features and functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the embodiments contained herein.

What is claimed is:

1. A solenoid for a motor vehicle starter, the solenoid comprising:

at least one coil wound on at least one spool, the at least one coil defining a first end, a second end, and a winding axis, wherein a toroidal space encircles the at least one coil about the winding axis between the first end and the second end of the at least one coil, wherein the at least one coil and the at least one spool includes a first coil wound on a first spool and a second coil wound on a second spool, wherein the second coil defines the toroidal space, and wherein the second spool includes an end flange with at least one opening providing a passage from a first side to a second side of the end flange;

a stop member positioned between the first spool and the second spool, wherein the stop member includes at least one opening providing a passage from a first side to a second side of the stop member, the first side of the stop member facing the first coil and the second side of the stop member facing the second coil, wherein the diode holder extends away from the second side of the stop member;

a diode holder positioned in the toroidal space and extending through the opening in the end flange; and a diode positioned in the diode holder, the diode including a cylindrical body, a first lead extending from a first end of the cylindrical body, and a second lead extending from a second end of the cylindrical body, the cylindrical body retained by the diode holder within the toroidal space, the first lead extending out of the toroidal space and electrically connected to the stop member.

2. The solenoid of claim 1 wherein the diode holder is a first diode holder in the toroidal space and the first diode is electrically connected in parallel to the first coil, the solenoid further comprising a second diode holder positioned in the toroidal space with the second diode positioned in the second diode holder, the second diode electrically connected in parallel with the second coil.

3. The solenoid of claim 1 further comprising a spacer positioned between the second spool and the stop member.

4. The solenoid of claim 3 wherein the spacer is comprised of a generally non-electrically conductive material and the stop member is comprised of a generally electrically conductive material.

5. The solenoid of claim 3 wherein the stop member is a metallic plate, wherein the spacer abuts the first side of the metallic plate and extends into the at least one opening of the stop member, the diode holder and the spacer forming a monolithic component.

6. The solenoid of claim 5 wherein the stop member defines a perimeter wall extending between the first side and the second side of the metallic plate, wherein the monolithic component includes a bending tab that projects outward from the perimeter wall, and wherein the first lead bends around the bending tab.

7. The solenoid of claim 1 wherein the opening in the end flange is provided by a recess in a perimeter of the end flange.

8. The solenoid of claim 1 wherein the cylindrical body of the diode defines an axis that is parallel to an axis defined by the at least one coil.

9. A motor vehicle starter comprising: an electric motor retained within a motor housing;

a solenoid housing adjacent to the motor housing;

at least one plunger assembly configured to move within the solenoid housing;

at least one spool arranged in the solenoid housing, the at least one spool including a first end flange and a second end flange;

at least one coil retained on the at least one spool;

at least one diode holder arranged in the housing between the first end flange and the second end flange of the spool, the at least one diode holder including at least one diode cavity and a bend tab; and at least one diode retained in the at least one diode cavity of the at least one diode holder, the at least one diode including a cylindrical body, a first lead, and a second lead, wherein the first lead is bent around the bend tab, and wherein the at least one diode is electrically connected to the at least one coil.

10. The motor vehicle starter of claim 9 wherein the at least one coil defines a coil axis and the at least one diode includes a cylindrical body defining a diode axis, wherein the diode axis is parallel to the coil axis.

11. The motor vehicle starter of claim 10 wherein the at least one coil and the at least one spool includes a first coil wound on a first spool, a second coil wound on a second spool, and a stop member positioned between the first spool and the second spool.

12. The motor vehicle starter of claim 11 wherein the diode holder is a first diode holder arranged in the housing between the first end flange and the second end flange, the at least one diode is a first diode electrically connected in parallel to the first coil, the solenoid further comprising a second diode holder electrically connected in parallel with the second coil.

13. The solenoid of claim 1 wherein the diode holder includes a body providing at least one diode cavity configured to receive the cylindrical body of the diode.

14. A motor vehicle starter comprising:

an electric motor retained within a motor housing;

a solenoid housing adjacent to the motor housing;

at least one plunger assembly configured to move within the solenoid housing;

a first spool and a second spool arranged in the solenoid housing, the first spool and the second spool including at least a first end flange and a second end flange;

a first coil wound on the first spool and a second coil wound on the second spool;

a stop member positioned between the first spool and the second spool;

a first diode holder and a second diode holder arranged in the housing between the first end flange and the second end flange;

a first diode retained in the first diode holder and electrically connected in parallel to the first coil; and a second diode retained in the second diode holder and electrically connected in parallel with the second coil; wherein the second coil defines a toroidal space with the first diode holder and the second diode holder positioned within the toroidal space; and wherein the second spool includes an end flange with at least one opening providing a passage from a first side to a second side of the end flange; wherein the second a diode holder is positioned in the toroidal space and extends through the opening in the end flange.

15. The motor vehicle starter of claim 14 wherein the first coil and the second coil define a coil axis and the first diode and the second diode each include a cylindrical body defining a diode axis that is parallel to the coil axis.

16. The motor vehicle starter of claim 14 wherein the second diode holder includes at least one diode cavity and a bend tab, and wherein the second diode includes a lead that is bent around the bend tab.

17. The motor vehicle starter of claim 11 wherein the stop member is comprised of a generally electrically conductive material.

* * * * *